US007966958B2

(12) United States Patent
Cauley

(10) Patent No.: US 7,966,958 B2
(45) Date of Patent: Jun. 28, 2011

(54) PONTOON LIFT MECHANISM

(76) Inventor: Dan Cauley, Elm Grove, WI (US)

( * ) Notice: Subject to any disclaimer, the term of this patent is extended or adjusted under 35 U.S.C. 154(b) by 139 days.

(21) Appl. No.: 12/427,713

(22) Filed: Apr. 21, 2009

(65) Prior Publication Data

US 2010/0263580 A1 Oct. 21, 2010

(51) Int. Cl.
*B63C 1/02* (2006.01)

(52) U.S. Cl. ..... 114/45

(58) Field of Classification Search ..... 114/45
See application file for complete search history.

(56) References Cited

U.S. PATENT DOCUMENTS 2,834,311 A * 5/1958 Engstrand ..... 114/45
4,280,429 A * 7/1981 Wells ..... 114/45
6,923,133 B1 * 8/2005 Ross et al. ..... 114/45

* cited by examiner

*Primary Examiner* — Stephen Avila
(74) *Attorney, Agent, or Firm* — Jerry D. Haynes; Law Office of Jerry D. Haynes

(57) ABSTRACT

The present invention relates to a pontoon lift mechanism includes: a plurality of PVC tubing aligned in parallel; a portion of the plurality of PVC tubing including air filled PVC tubes; a portion of the plurality of PVC tubing including water filled PVC tubes; and an inlet valve and outlet valve provided for each PVC tube. The air filled PVC tubes and water filled PVC tubes abut each other and alternate in the parallel alignment of the tubes. The pontoon lift mechanism also includes a means to fill the air filled PVC tubes and the water filled PVC tubes, where said means to fill includes an air hose extending from an air supply valve and a water hose extending from a water supply valve.

1 Claim, 1 Drawing Sheet

PONTOON LIFT MECHANISM

BACKGROUND OF THE INVENTION

1. Field of Invention

The present invention relates to a pontoon lift mechanism.

2. Description of Related Art

Many floating boatlifts incorporate pontoon mechanisms as a means of lifting and lowering a boat. Some of the mechanisms used as a pontoon include air and hydraulic systems. Normally air may be inserted within the floatation mechanism in order to provide a lifting of the boat or released in order to provide a lowering of the boat. A number of boatlifts utilize air exclusively as a means of raising and lowering a boat. Other lifts utilize water or hydraulic systems to activate the lifting and lowering mechanisms of a boatlift.

Boat lifts in general assist boaters in the movement of the boat and aid in the maintenance of the boat. Boatlifts can prevent hull damage and enable suitable launching of a boat from a shore or dock area.

SUMMARY OF THE INVENTION

The present invention relates to a pontoon lift mechanism comprising: a plurality of PVC tubing aligned in parallel; a portion of the plurality of PVC tubing including air filled PVC tubes; a portion of the plurality of PVC tubing including water filled PVC tubes; and an inlet valve and outlet valve provided for each PVC tube. The air filled PVC tubes and water filled PVC tubes abut each other and alternate in the parallel alignment of the tubes. The pontoon lift mechanism also includes a means to fill the air filled PVC tubes and the water filled PVC tubes, where said means to fill includes an air hose extending from an air supply valve and a water hose extending from a water supply valve.

DETAILED DESCRIPTION

Figure 1:
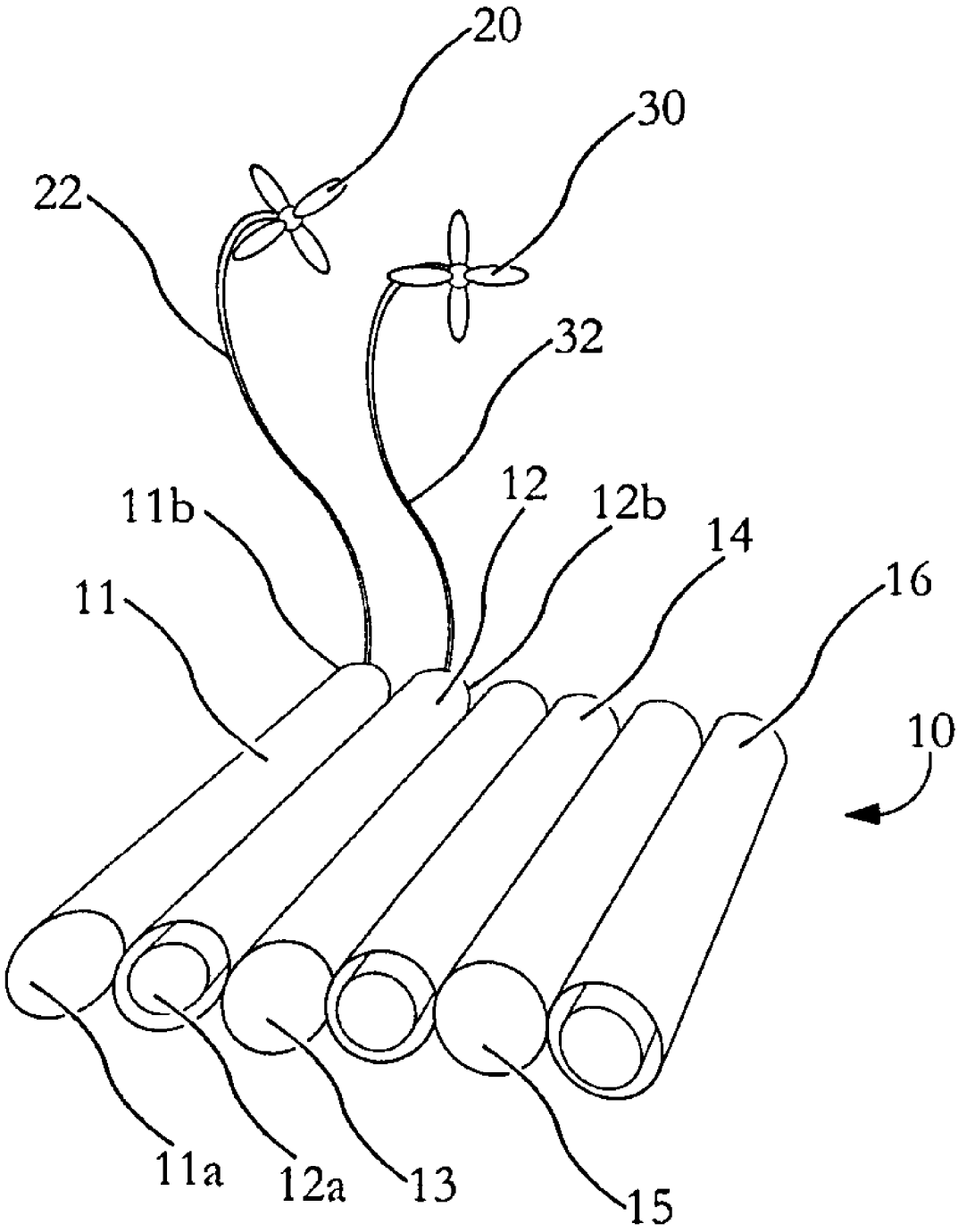
FIG. 1 depicts a pontoon-lift configuration according to the present invention.

The present invention provides a pontoon lifting mechanism that includes a series of PVC tubing connected that provides the lifting mechanism for a boat lift. The PVC tubing includes a series of tubes that are connected as the support for a boatlift. Although not shown the grouping of PVC tubing is positioned between four supporting adjustable legs that guide the plurality of PVC tubing vertically.

FIG. 1 shows the configuration for the series of PVC tubing according to the present invention. A Pontoon Lifting Mechanism 10 includes a series of PVC tubing adjoined wherein the tubings utilizes either air or water to move the lifting mechanism of the boatlift. As depicted Tubings 11, 13 and 15 represent water-filled PVC tubes. Each PVC tube includes an inlet and an outlet. An Inlet 11*b* is depicted in FIG. 1 with an Outlet 11*a*. An Air Valve 30 provides an Air Hose 32 that connects to the air-filled PVC Tube 12. The air hose connects to an inlet opening 12*b* and the Air Tube 12 also includes an outlet 12*a*. The water-filled PVC Tube 11 includes the Inlet 11*b* and Outlet 11*a* wherein a water hose 22 connects to the Inlet 11*b* of the water-filled Tube 11. The series of PVC Tubing 10 according to the present invention alternates between water-filled PVC tubing as opposed to air-filled PVC tubing. The series of alternating tubing provides a complete lifting mechanism for a boatlift.

The Water Hose 22 connected to a Water Valve 20 may connect to each water-filled PVC tube along with a series of PVC tubing. As depicted in FIG. 1, the water-filled PVC tubing includes 11, 13, and 15. The air-filled PVC tubing includes PVC tubes 12, 14, 16. As depicted FIG. 1, only a portion of the series of PVC tubing that may be used as a lifting mechanism for a boat is shown. Although a specific number of tubes is not pre-determined but the series of tubings should be of sufficient length and width in order to support a desired size boatlift. Ideally, the boatlift functions in a manner where air is added to the PVC tubing provided in the series in order to effectively lift a boat as desired. Once the boat is in a suitable position a user may then release the air from the PVC tubing from the outlets provided on each air PVC tube. In order to place the boat lift in a resting or down position water is placed in the PVC tubing provided in this series of PVC tubing according to the present invention.

Consequently, this series of PVC tubing utilized in the present invention a more functional and easier to use boatlift. The PVC tubing assembly may be attached to a boatlift via metal brackets with four adjustable support legs that guide the boatlift vertically. The configuration for the PVC tubing lifting mechanism therefore provides a unique and effective manner to support a boat in a boatlift. The supporting structure is easy to use and utilizes both air and water tubing to effectively lift the boat as needed.

The instant invention has been shown and described in what is considered to be the most practical and preferred embodiments. It is recognized, however, that departures may be made there from within the scope of the invention and that obvious modifications will occur to a person skilled in the art.

What is claimed is:

1. A method of providing a pontoon lift mechanism comprising the steps of:

a. aligning a series of PVC tubing in a parallel formation;

b. alternating between an air filled PVC tube and a water filled PVC tube within the parallel alignment;

c. filling the air filled PVC tubing with air in order to elevate the lift mechanism;

d. releasing the air within the air filled PVC tubing in order to lower the lift mechanism;

e. filling the water filled PVC tubing with water to further lower the lift mechanism;

f. inserting an air hose to an inlet valve of each air filled PVC tubing to perform the step of filling;

g. opening an outlet valve of each air filled PVC tubing to perform the step of releasing; and h. inserting a water hose to an inlet valve of each water filled PVC tubing to perform the step of filling.

* * * * *